US008657460B2

(12) United States Patent
Bhardwaj et al.

(10) Patent No.: US 8,657,460 B2
(45) Date of Patent: Feb. 25, 2014

(54) LAMP WITH ORIENTABLE LIGHTING SOURCE

(75) Inventors: Dhruv Bhardwaj, Bangalore (IN); Sai Krishna Kunchala, Andhra Pradesh (IN); Rupan Sarkar, Bangalore (IN)

(73) Assignee: Schneider Electric Industries SAS, Rueil-Malmaison (FR)

( * ) Notice: Subject to any disclaimer, the term of this patent is extended or adjusted under 35 U.S.C. 154(b) by 200 days.

(21) Appl. No.: 13/188,865

(22) Filed: Jul. 22, 2011

(65) Prior Publication Data

US 2012/0057333 A1 Mar. 8, 2012

(30) Foreign Application Priority Data

Jul. 22, 2010 (IN) ..... 1723/DEL/2010

(51) Int. Cl.
*F21L 4/00* (2006.01)

(52) U.S. Cl.
USPC . 362/183; 362/157; 362/249.03; 362/249.07; 362/249.1

(58) Field of Classification Search
USPC ..... 362/227, 232–233, 235–236, 238, 240, 362/249.01–249.03, 249.07, 269, 285, 287, 362/362–363, 367–368, 382, 800, 157, 183, 362/249.1
See application file for complete search history.

(56) References Cited

U.S. PATENT DOCUMENTS

| | | | |
|---|---|---|---|
| 5,559,393 | A | 9/1996 | Nilssen |
| 2002/0067143 | A1 | 6/2002 | Robinett et al. |
| 2005/0231381 | A1 | 10/2005 | Pederson et al. |
| 2006/0043911 | A1 | 3/2006 | Shao et al. |
| 2008/0212329 | A1 | 9/2008 | Duguay et al. |
| 2009/0109670 | A1 | 4/2009 | Boyer |
| 2009/0116210 | A1 | 5/2009 | Cutler et al. |
| 2009/0174542 | A1 | 7/2009 | Gentry et al. |

FOREIGN PATENT DOCUMENTS

| | | | |
|---|---|---|---|
| EP | 2023037 | A1 | 2/2009 |
| WO | 0233311 | A1 | 4/2002 |

OTHER PUBLICATIONS

Notification of Transmittal of the International Search Report and the Written Opinion of the International Searching Authority, PCT/IB 11/01711, dated Dec. 19, 2011.

*Primary Examiner* — Stephen F Husar
*Assistant Examiner* — Meghan Dunwiddie
(74) *Attorney, Agent, or Firm* — Lando & Anastasi, LLP

(57) ABSTRACT

Various embodiments disclosed herein are directed to a portable lamp. Various embodiments of the portable lamp comprise a base having an upper surface, a substrate coupled to the base on the upper surface of the base, the substrate including at least one surface having a plurality of light emitting units disposed thereon, the substrate being movable relative to the base to direct light emitted from the light emitting units in a desired direction, and a light-transmitting cover surrounding the substrate.

21 Claims, 11 Drawing Sheets

LAMP WITH ORIENTABLE LIGHTING SOURCE

RELATED APPLICATIONS

Foreign priority benefits are claimed under 35 U.S.C. §119 (a)-(d) or 35 U.S.C. §365(b) of Indian application number 1723/DEL/2010, filed Jul. 22, 2010.

BACKGROUND OF INVENTION

1. Field of Invention

The present invention is directed to illumination devices, and more specifically, to electrical lamps having reorientable lighting panels.

2. Discussion of Related Art

In underdeveloped and/or developing countries and in rural areas, the availability of reliable electric grid power systems remains spotty at best and alternative electrical source systems can be expensive to install and operate and are not always compatible with available lighting systems. Further, alternate lighting systems often do not provide sufficient room level lighting. As an alternative to electrical lighting in these areas, kerosene lamps are often used, and while these can reliably provide continuous light, they can be dangerous to use, cause health problems, and contribute to increases in atmospheric $CO_2$.

SUMMARY OF INVENTION

At least one embodiment discussed herein is directed to an efficient lighting system for use particularly in areas having unreliable and or prohibitively expensive electric grid systems.

A first aspect of the invention is directed to a portable lamp. The portable lamp comprises a base having an upper surface, a substrate coupled to the base on the upper surface of the base, the substrate including at least one surface having a plurality of light emitting units disposed thereon, the substrate being movable relative to the base to direct light emitted from the light emitting units in a desired direction, and a light-transmitting cover surrounding the substrate.

In some embodiments, the substrate includes at least two panels rotatably mounted about a vertical axis perpendicular to the upper surface of the base, a first of the at least two panels being rotatable relative to a second of the at least two panels.

In some embodiments, each of the plurality of light emitting units comprises a light emitting diode.

In some embodiments, the at least two panels are configured to rotate into positions such that the at least two panels are substantially coplanar.

In some embodiments, the at least two panels are configured to rotate into positions wherein the at least two panels substantially circumscribe a closed two dimensional polygon oriented perpendicular to the vertical axis.

In some embodiments, each of the at least two panels is hingedly coupled to at least one other of the at least two panels.

In some embodiments, the base includes a compartment for at least one battery, and the at least two panels are configured to be powered by the at least one battery.

In some embodiments, the base includes a dynamo configured to be manually operated to charge the at least one battery.

In some embodiments, the portable lamp further comprises a solar cell configured to simultaneously provide power for illumination of the plurality of light emitting units as well as charge the at least one battery upon exposure of the solar cell to light.

In some embodiments, the portable lamp further comprises an AC power inlet.

In some embodiments, the portable lamp further comprises a first circuit configured to simultaneously provide power for illumination of the plurality of light emitting units as well as charge a battery included in the portable lamp with power provided through the AC power inlet.

In some embodiments, the portable lamp further comprises a second circuit configured to detect the availability of power from the AC inlet and the solar cell, and when power is available from both the AC inlet and the solar cell, to operate the lamp using power from the solar cell only.

In some embodiments, the portable lamp further comprises a third circuit configured to detect the unavailability of power from the AC inlet, the solar cell, and the dynamo, and in response, switch from a mode in which the substrate is operated utilizing power provided through the AC inlet, the solar cell, or the dynamo to a mode in which the substrate is operated utilizing power provided by the battery.

Another aspect of the invention is directed to a method of operating a lamp including a plurality of configurable lighting panels. The method comprises electrically coupling a source of power to the plurality of configurable lighting panels, and orienting the plurality of configurable lighting panels in a desired position ranging from an open position in which the plurality of configurable lighting panels are positioned in a substantially planar configuration and a closed position in which the plurality of configurable lighting panels circumscribe a substantially closed two dimensional figure.

In some embodiments, the method further comprises electrically coupling a source of power positioned external to the lamp to a source of power positioned internal to the lamp.

In some embodiments, the method further comprises orienting the plurality of configurable lighting panels into an intermediate position in which the plurality of configurable lighting panels are positioned in a substantially non-planar configuration.

Another aspect of the invention is directed to a lamp. The lamp comprises base and a plurality of light panels, each configured to extend from the base in a first direction defined by a first axis, and each having a plurality of lighting elements configured to provide illumination along at least one of a plurality of axes that reside in a first plane which is perpendicular to the first axis, wherein each of the plurality of light panels are rotatably mounted to the base and rotatable about a rotation axis that is parallel to the first axis.

In some embodiments, a first of the plurality of light panels is rotatable relative to a second of the plurality of light panels.

In some embodiments, the first of the plurality of light panels and the second of the plurality of light panels are configured to rotate into positions such that the first of the plurality of light panels and the second of the plurality of light panels are substantially coplanar.

In some embodiments, the first of the plurality of light panels and the second of the plurality of light panels are configured to rotate to a position wherein the plurality of light panels substantially circumscribe a closed two dimensional figure oriented perpendicular to the first axis.

In some embodiments, each of the plurality of light panels is hingedly coupled to at least one other of the plurality of light panels.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
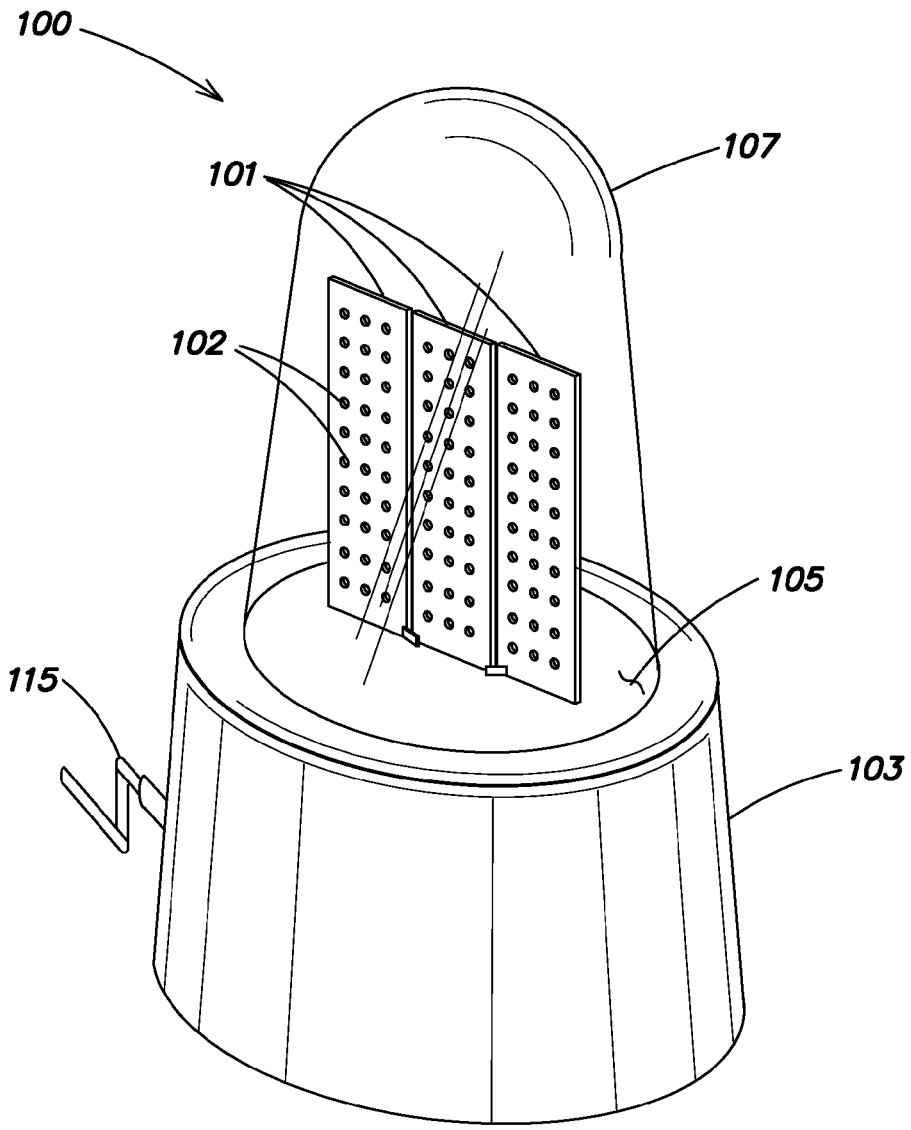
FIG. 1 is an isometric view of a lamp in accordance with one embodiment including a set of light emitting panels in an open position.

The systems and methods described herein are not limited in their application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

At least some embodiments disclosed herein are directed to modular, portable, lighting systems and methods, including LED lamps, operable from DC power sources including battery power sources, solar power, and AC power sources including a utility electrical grid, generator, or other AC power source. At least some embodiments are directed to LED lamps having LEDs arranged to provide full room lighting from a compact, portable unit, and are configurable for dual power mode operation and in some embodiments, to provide for low power operation on battery power.

At least some embodiments disclosed herein are directed toward lamps having one or more orientable light emitting panels or substrates. The terms "panels" and "substrates" are used interchangeably herein. In accordance with one embodiment, a lamp has a plurality of light emitting panels that may be oriented to provide light 360 degrees around the lamp. The light emitting panels are re-arrangeable or reorientable such that they can also provide light from the lamp substantially unidirectionally. In use, the lamp is configurable to provide light 360 degrees about the lamp when placed in the center of a room or a table, and configurable to provide a unidirectional light source when placed against a wall or in a corner of a room. Embodiments of the lamp may also provide illumination covering any desired angle between a single direction and 360 degrees.

In a first embodiment, illustrated in FIGS. 1-5, a portable lamp includes a plurality of light emitting panels 101. In FIGS. 1-5, the lamp is illustrated as including three light emitting panels 101, however, in alternate embodiments, more or fewer light emitting panels may be provided. For example, in some embodiments, only a single panel may be present in the lamp. In some embodiments, this single panel may be fixed relative to the base of the lamp, and in other embodiments, the single panel may be rotatable relative to the base, using for example a crank or a shank coupled to the panel and extending outward from a body or a cover of the lamp. Each of the light emitting panels includes an array of light emitting elements (also referred to herein as light emitting units) 102. In the embodiment illustrated, these light emitting elements are LEDs.

Figure 8:
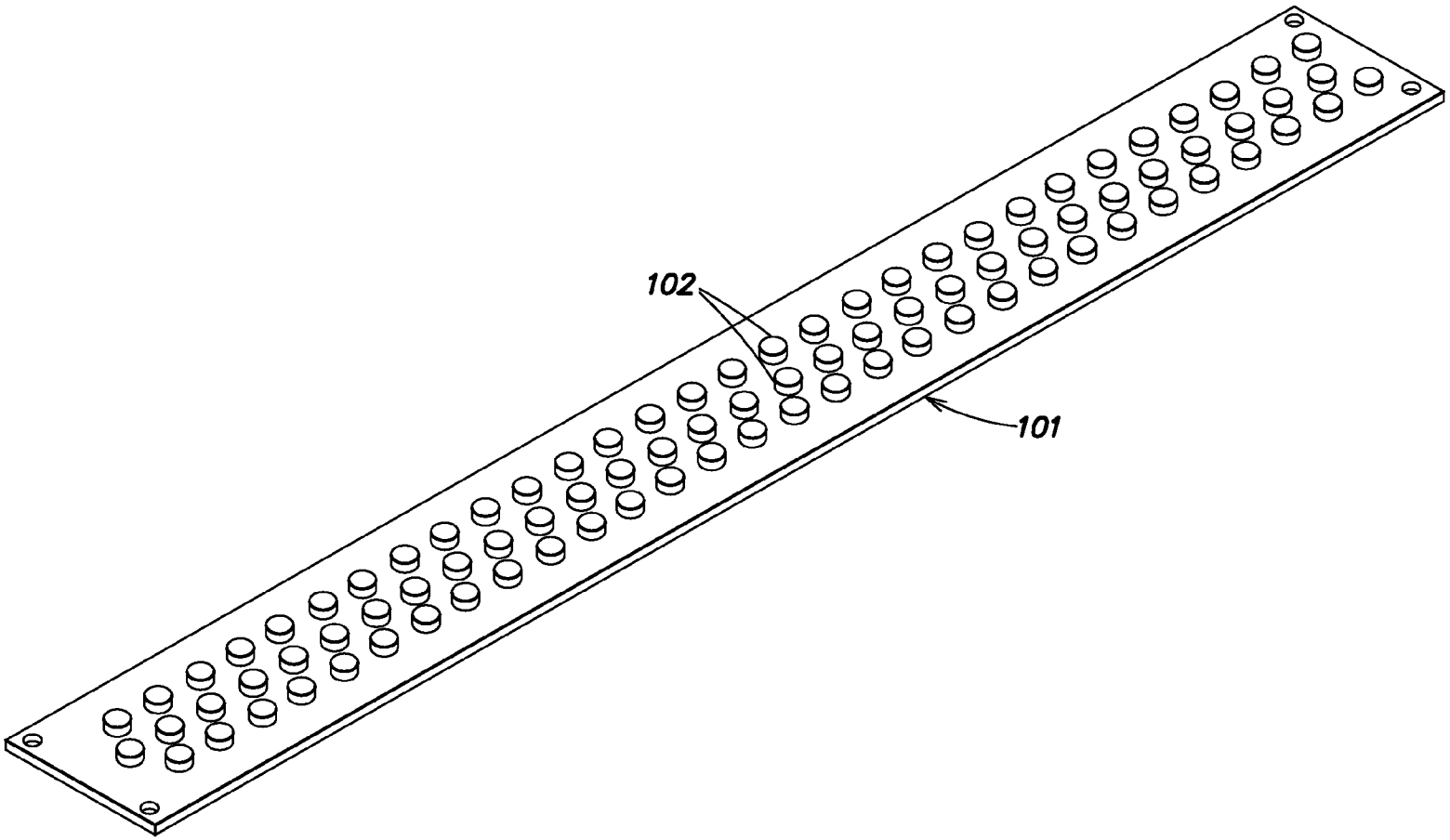
FIG. 8 shows an LED array used in the embodiment of FIGS. 1-5.

In one embodiment, the LED array 102 on each light emitting panel 101 is implemented using a 3×30 array of closely spaced LEDs as shown in FIG. 8. In one embodiment, the three rows are spaced 6.985 mm apart, with the LEDs of each row spaced at 8.6 mm intervals, and with each LED having a five mm diameter. In one embodiment, the LEDs have a forward voltage of 3.0 to 3.5 volts, a peak forward current of 20 mA, a reverse voltage of five volts, reverse current of ten microamps, a luminous intensity of 1500-2500 milli Candela (mcd) and are white with a wavelength of 5800K. In other embodiments, LEDs having different characteristics may be used.

In one embodiment, additional indicator lights, including for example, a green LED, a red LED, and/or a yellow LED are also provided, and in this embodiment, illumination of the green LED indicates that the power from the grid supply, the solar panel, or an alternate source of power is available and is charging a battery internal to the lamp, illumination of the yellow LED indicates that the battery is fully charged, and illumination of the red LED indicates that the battery is drained and load is cut off from the battery. In other embodiments, different of these LEDs are illuminated to indicate different conditions.

The light emitting panels 101 are mounted on a base 103 of the lamp 100, specifically on a top surface 105 of the base. A light transmitting cover 107 surrounds the light emitting panels 101. In some embodiments the light transmitting cover 107 is transparent and in other embodiments, the light transmitting cover 107 is translucent. The base 103 further includes a crank 115 protruding from a side thereof that is used to adjust the position of the light emitting panels 101, as will be explained to in further detail below. The lamp base 103 is in one embodiment made from plastic (for example, ABS Abstron IM 17A) while the cover 107 is made from transparent plastic (for example, PMMA 876G). In other embodiments, other plastic material(s) or metals can be used for the base 103 and the cover 107.

Figure 4:
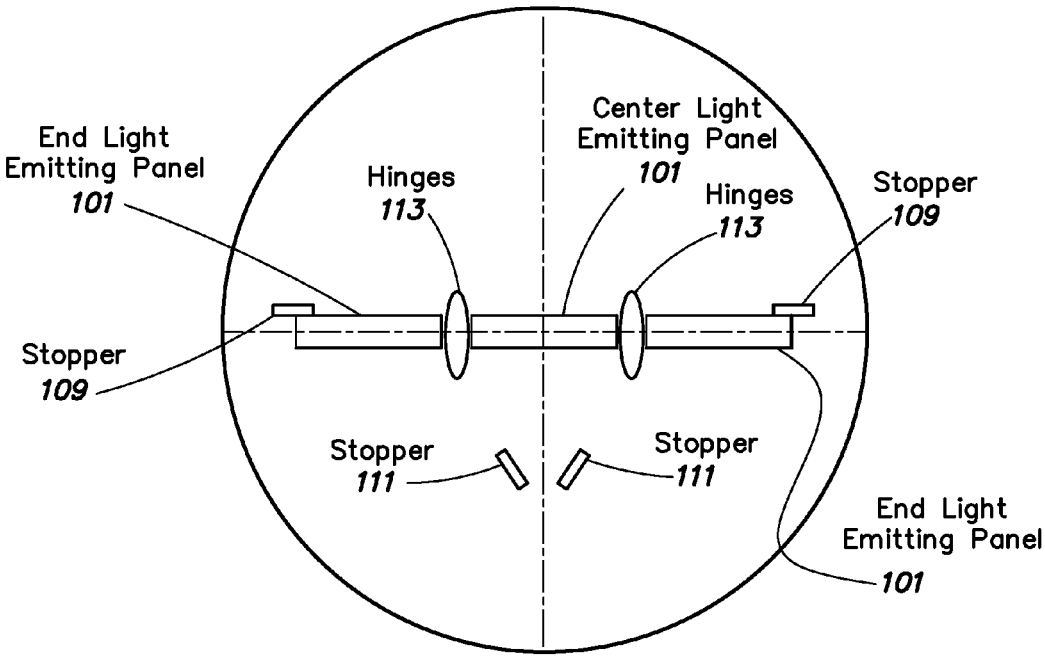
FIG. 4 is a plan view of the lamp of FIG. 1 from above, with the set of light emitting panels in an open position.

In the arrangement illustrated in FIGS. 1 and 4, the three light emitting panels 101 have substantially planar surfaces and are arranged co-planar with one another. In this arrangement, light produced by the three light emitting sources is cast substantially unidirectionally. Each of the LEDs in the LED array on each light emitting panel casts light in a conical pattern, in some embodiments, in a cone having both a horizontal and vertical angular spread of about 120 degrees. Thus, the light emitted by the lamp with the light emitting panels aligned as in FIGS. 1 and 4 would not be cast completely unidirectionally, but would have a degree of horizontal and vertical spread. In other embodiments, different LEDs or other light emitting elements which have a greater or lesser degree of spread in light emitted are used, thus providing for different angular areas that would be illuminated by the lamp when the light emitting elements were arranged as in FIGS. 1 and 4. In some embodiments, the light emitting panel 101 may be positioned to be parallel to one another, but not necessarily in a co-planar arrangement. In further embodiments, one or more of the light emitting panels may have a non-planar surface. For example, in some embodiments, one or more of the light emitting panels may have a curved surface upon which light emitting elements are mounted. In some embodiments one or more of the light emitting panels may comprise multiple sections, with at least one section joined to at least one other section at an angle.

Figure 5:
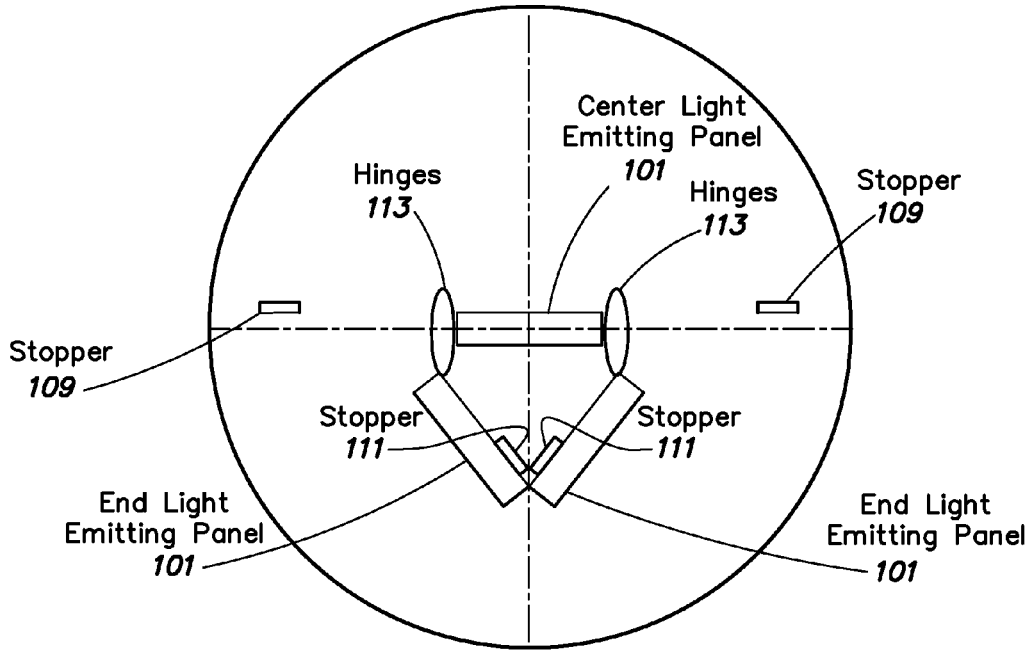
FIG. 5 is a plan view of the lamp of FIG. 1 from above, with the set of light emitting panels in a closed position.

In some embodiments, the light emitting panels 101 are attached to one another by hinges 113 (see FIGS. 4 and 5.) The hinges 113 provide for the light emitting panels to rotate relative to each other. In some embodiments, the light emitting panels are not attached directly to one another by the hinges 113. Rather, the hinges may be in the form of projections from either the top or bottom, or both of one or more of the light emitting panels which are inserted into holes or recesses in the top surface of the base 105, or in an internal surface of the cover 107, such as an internal surface proximate an upper portion of the cover 107. These projections may be in the form of rods. The hinges may thus, in some embodiments, both support the light emitting panels in place in the lamp and provide for rotation of the panels relative to one another. In some embodiments, the hinges 113 are omitted.

Figure 2:
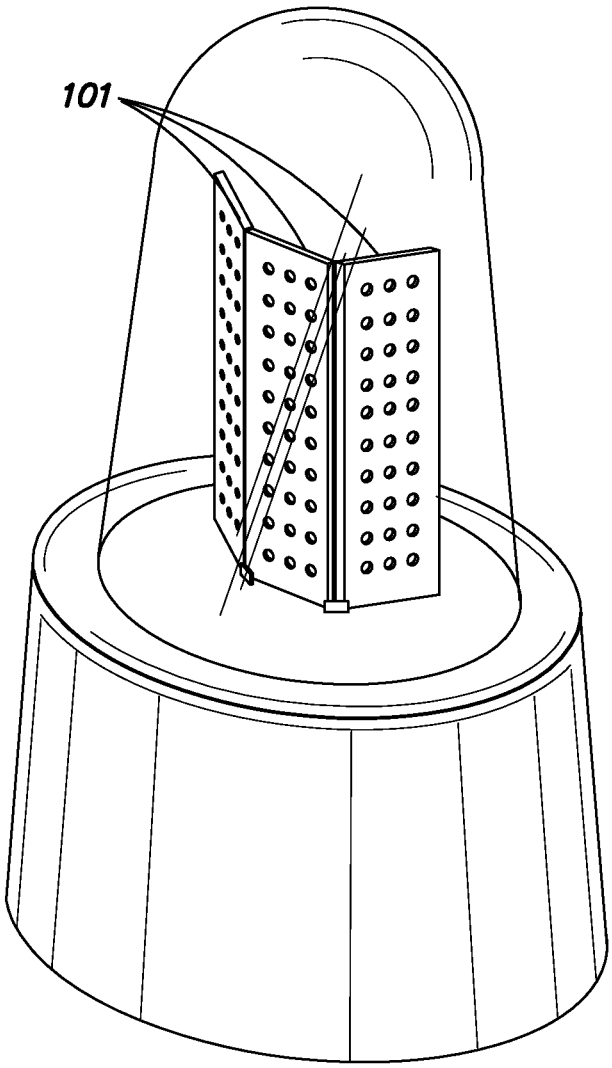
FIG. 2 is an isometric view of the lamp of FIG. 1 with the set of light emitting panels in a partially closed position.
Figure 3:
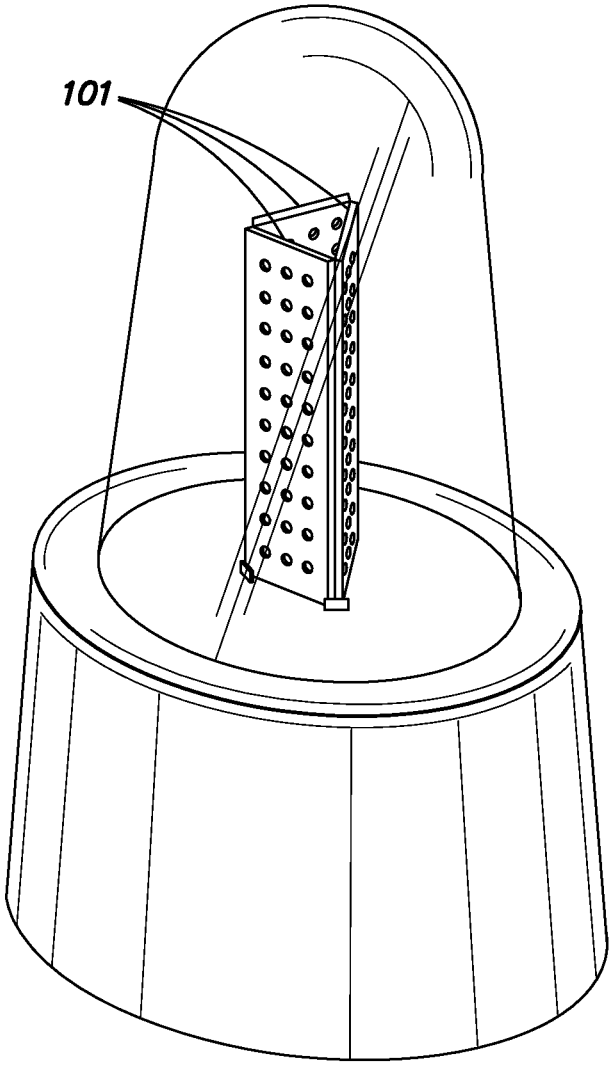
FIG. 3 is an isometric view of the lamp of FIG. 1 with the set of light emitting panels in a fully closed position.

In the arrangement shown in FIG. 2, the end light emitting panels 101 are angled relative to the center light emitting panel 101 by an angle of about 150 degrees. This arrangement of the light emitting panels 101 provides for the emission of light covering a greater horizontal area than in the arrangement of light emitting panels illustrated in FIGS. 1 and 4. FIGS. 3 and 5 illustrate the light emitting panels 101 angled relative to one another in a closed position such that the end light emitting panels 101 contact each other along an outer edge. The three light emitting panels 101 thus completely surround an area between them. In the arrangement in FIGS. 3 and 5, this area approximates a triangle in cross section in a plane perpendicular to a vertical axis of the lamp when viewed from above. In embodiments where a greater number of light emitting panels are used, when in a closed position, a different two-dimensional polygon would be circumscribed by the inner surfaces of the light emitting panels. For example, in embodiments including four light emitting panels, when the light emitting sources are in a closed position, they define an area with a square or rectangular cross section when viewed from above. In some embodiments, one or more of the light emitting panels may be non-planar. Thus, in some embodiments, when the light emitting panels are in a closed portion, the area surrounded by the light emitting panels may be a figure other than a polygon, for example, a circle, an ellipse, or a triangle or rectangle with curved sides.

In some embodiments, the end light emitting panels 101 do not make physical contact with each other along their outer edges, but rather are configured to maintain a small spacing between their respective outer edges. Maintaining a small spacing between the outer edges of the end light emitting panels 101 prevents the end light emitting panels 101 from colliding with, and potentially damaging each other. In embodiments wherein a small spacing is maintained between the outer edges of the end light emitting panels 101, when the light emitting panels 101 are angled relative to one another in a closed position, the light emitting panels 101 will circumscribe a substantially closed two dimensional polygon oriented perpendicular to a vertical axis of the lamp.

Figure 6:
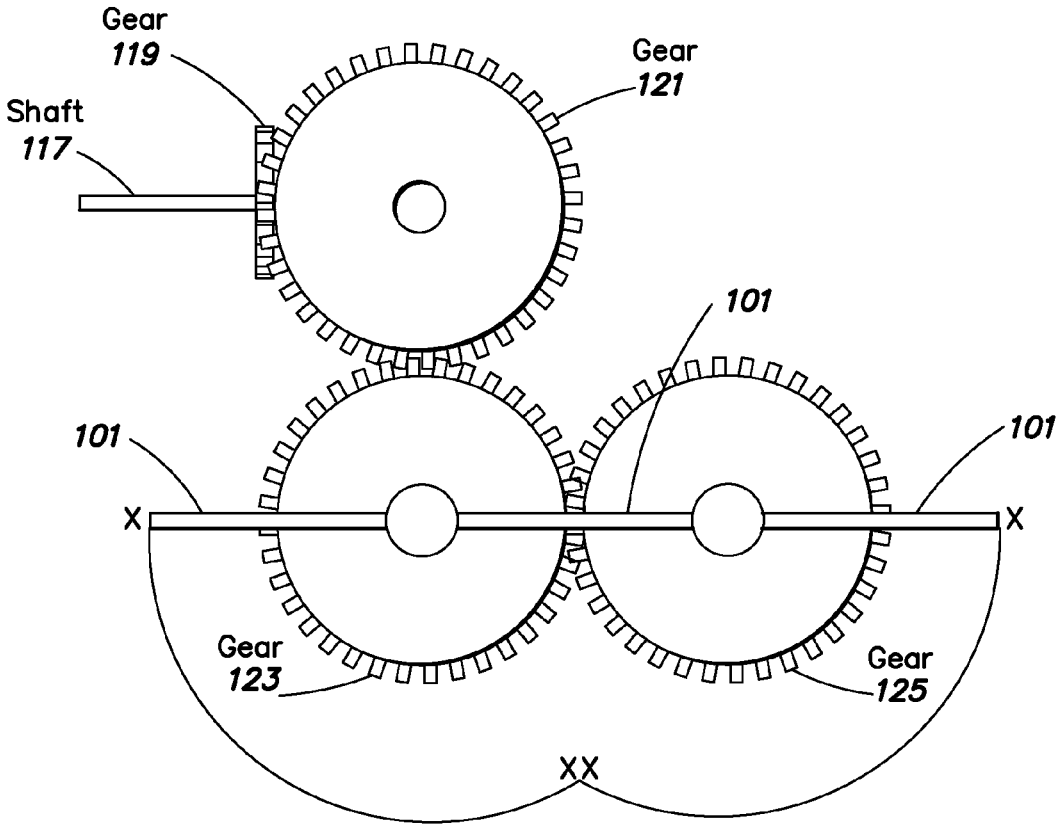
FIG. 6 illustrates a set of gears for reorienting the light emitting panels according to one embodiment, with the set of light emitting panels in an open position.
Figure 7:
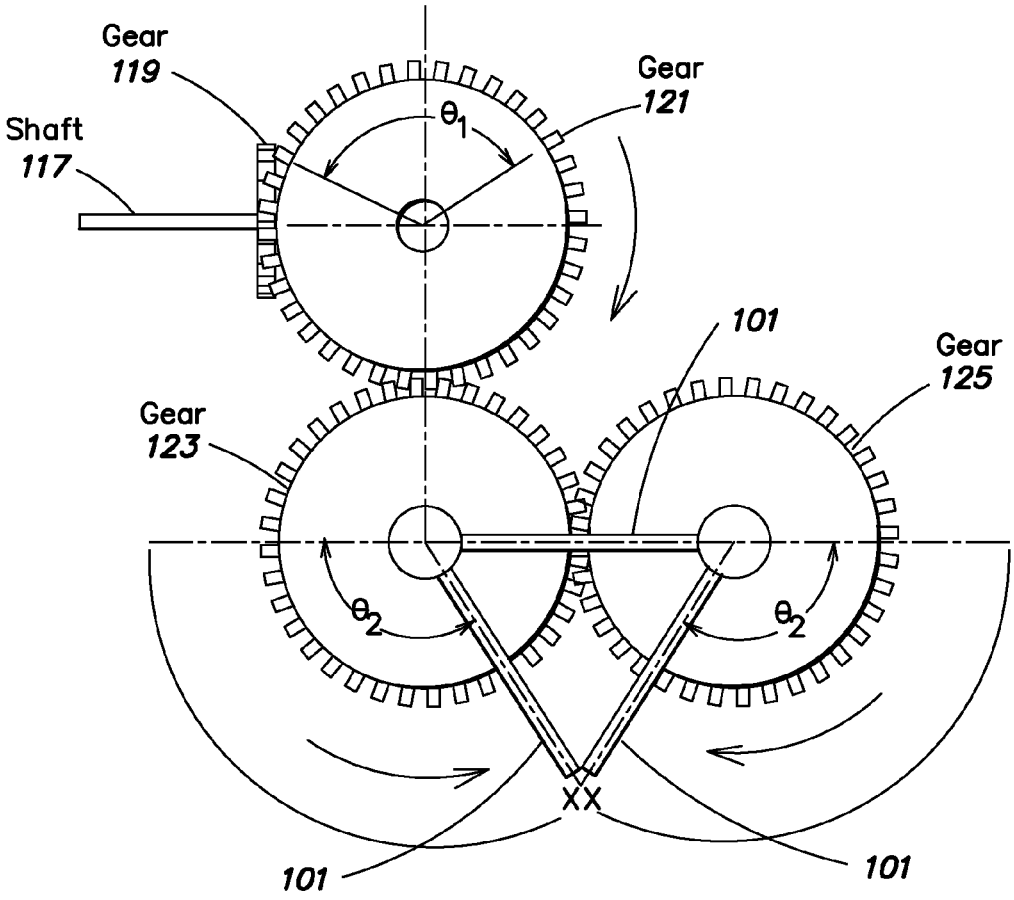
FIG. 7 illustrates a set of gears for reorienting the light emitting panels according to the embodiment of FIG. 6, with the set of light emitting panels in a closed position.

The light emitting panels 101 are rotated relative to each other by manual rotation of the crank 115. In one embodiment, the crank 115 is mechanically coupled to a series of gears, as is illustrated in FIGS. 6 and 7. Crank 115 is mechanically coupled through shaft 117 to gear 119. Teeth of gear 119 interlock with teeth of gear 121. Thus, a rotation of crank 115 about a horizontal axis relative to the base of the lamp causes a rotation of gear 119 about the horizontal axis and rotation of gear 121 about a vertical axis relative to the base of the lamp.

Gear 121 is mechanically coupled to gear 123 and, through gear 123, to gear 125. End light emitting panels 101 are mechanically coupled to gears 123 and 125. The crank 115 may be used as a user interface to rotate one or more of the gears 121, 123, 125 and/or the light emitting panels 101. A rotation of crank 115 which results in a clockwise rotation of gear 121, as viewed from above, will cause a counterclockwise rotation of gear 123 and a clockwise rotation of gear 125. Starting from an open position of end light emitting panels 101, as illustrated in FIG. 6, a counterclockwise rotation of gear 123 and the clockwise rotation of gear 125 will cause end light emitting panels 101 to rotate coaxially with gears 123 and 125, transitioning from the open position to a closed position, as illustrated in FIG. 7. In some embodiments, the crank 115 is located on an underside of the base 103 of the lamp, and is connected directly to gear 119, or in other embodiments, through another gear which is coupled to gear 119. In some embodiments, a series of belts mounted about a group disks are utilized instead of gears to transmit motion from the crank to the light emitting panels.

In some embodiments, stoppers 109 and 111 are provided on the surface 105 of the base of the lamp. Stoppers 109 and 111 are protrusions from the upper surface 105 of the base 103. These stoppers 109 and 111 prevent the rotation of the end light emitting panels 101 past defined positions. The utilization of stoppers 109 and 111 to constrain the range of rotation of end light emitting panels 101 prevents the light emitting panels 101 from being rotated into positions where they would impact each other or overextend the hinges 113. The utilization of stoppers 109 and 111 to constrain the range off rotation of the end light emitting panels 101 thus reduces the potential for a user to inadvertently damage elements of the lamp 100. In some embodiments, the stoppers extend upward from the upper surface 105 of the base 103 to a height above a lower edge of the light emitting panels 101. In some embodiments, the stoppers 109, 111, do not block light from any of the light emitting elements in the arrays of light emitting elements 102 on the light emitting panels 101. In some embodiments, the stoppers 109, 111 are shaped as rectangular protrusions, and in other embodiments are shaped as cylinders or pins protruding from the upper surface 105 of the base 103. In some embodiments, some of the stoppers 109, 111 are shaped differently than others of the stoppers 109, 111. Embodiments of the lamp are not limited to any particular shape of stoppers 109, 111.

In alternate embodiments, different arrangements of gears are used to rotate the light emitting panels 101. For example, additional gears may be used to reposition or rotate the light emitting panels when more than three light emitting panels 101 are used in the lamp 100. It would be apparent to one of skill in the art how to design various gearing systems to rotate/reposition of any number of light emitting panels.

In further embodiments, rather that using a crank 115 to rotate/reposition the light emitting panels 101, an electric motor is used to rotate/reposition the light emitting panels 101. In some embodiments, a user would press a button (or, in some embodiments, reposition a switch) to move the light emitting panels from an open arrangement (for example, as illustrated in FIG. 1) through various positions including a closed position (for example, as illustrated in FIG. 3), and press another button (or in some embodiments, reposition the switch into another position) to move the light emitting panels 101 from a closed arrangement toward an open arrangement. In some embodiments, the electric motor would take the place of the crank 115 and drive gears such as gears 119, 121, 123, and 125 in a similar manner as rotation of the crank 115 would. In other embodiments, multiple electric motors are used to move one or more light emitting panels each.

Figure 9:
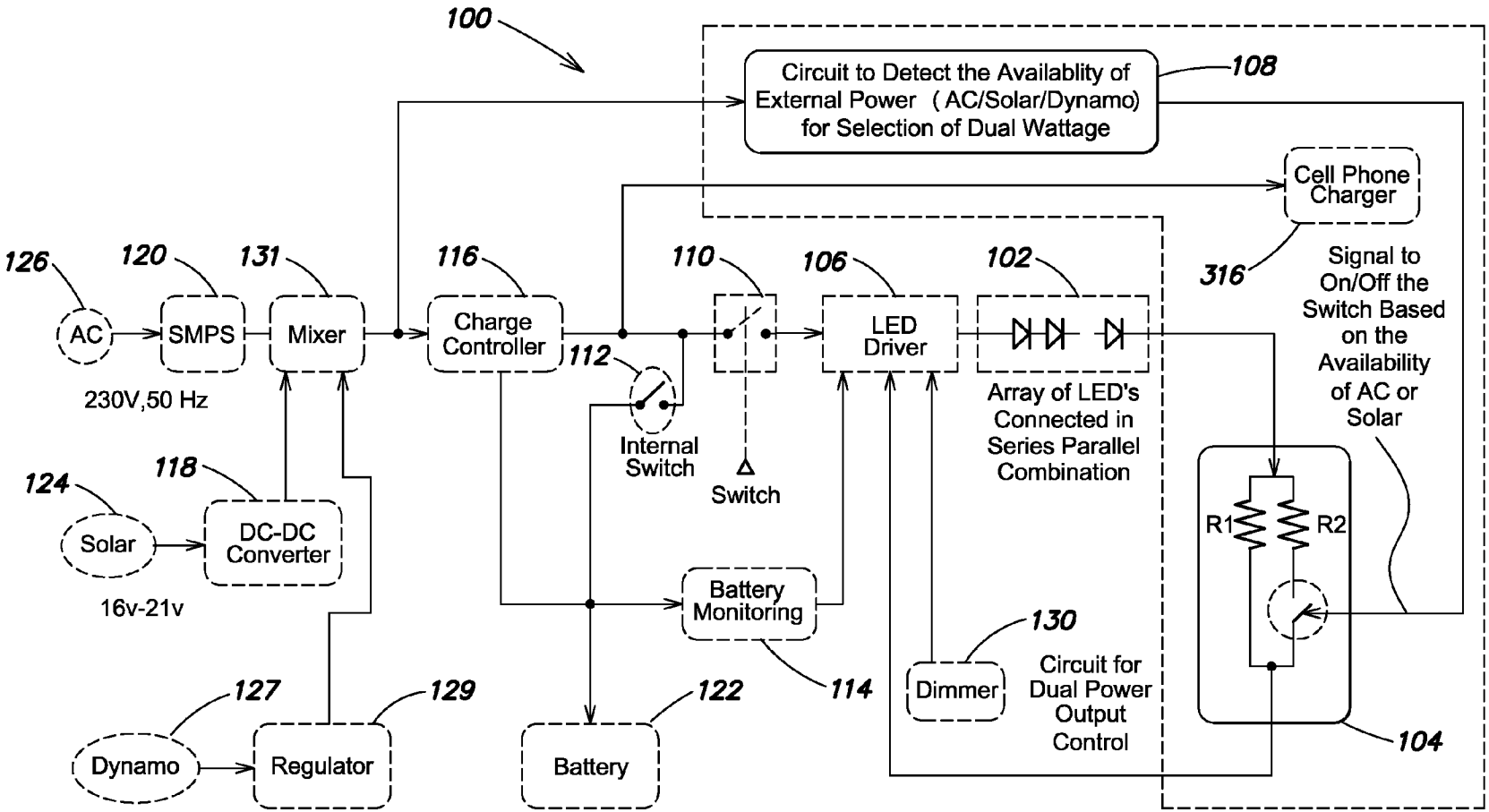
FIG. 9 shows a functional block diagram of a lamp in accordance with one embodiment.

FIG. 9 is directed to a functional block diagram of the lamp 100 in accordance with one embodiment. The lamp 100 includes an array of LEDs 102, a dual power output control circuit 104, an LED driver circuit 106, a detection circuit 108, mode switches 110 and 112, a battery monitoring circuit 114, a charge control circuit 116, a DC-DC converter 118, a switch mode power supply (SMPS) 120, a battery 122, a solar power source 124, an AC power source 126, a dynamo 127 and associated regulator 129, and power supply mixer 131. In some embodiments, the lamp 100 may also include an electrical connection 316 for charging a cell phone. In different embodiments, functional circuits are grouped differently than shown in FIG. 9. As used below, references to the LED array 102 are meant to encompass the LED arrays 102 on each light emitting panel 101 of the lamp 100.

The LED array 102 is coupled between the dual power output control circuit 104 and the LED driver 106. Mode switches 110 and 112 are coupled between the LED driver circuit 106 and the battery 122, and the mode switches are also coupled to an output of the charge controller 116. The DC-DC converter 118 is coupled between the solar power source 124 and the mixer 131 and the charge controller 116. The SMPS 120 is coupled between the AC power source and the mixer 131 and the charge controller 116. The regulator 129 is coupled between the dynamo 127 and the mixer 131 and the charge controller 116. The battery 122 is coupled to the charge controller 116, mode switch 112, and the battery monitoring circuit 114. The detection circuit 108 is coupled to the SMPS 120 output, DC-DC converter 118 output, the regulator 129 output, and the dual power output control circuit 104.

In operation, light is provided by the LED array from power provided from one of the AC power source 126, the solar power source 124, the dynamo 127, and the battery 122. When operated from the AC power source, the SMPS receives the input AC power and converts the AC power to DC power. In one embodiment, the input AC voltage is 230 volts at 50 Hz, although in other embodiments, other input voltages at other frequencies may also be used. In one embodiment, the output of both the SMPS 120 and the regulator 129 is 9.3 volts, but other output voltages may also be used.

The charge controller 116 receives the voltage from the SMPS and provides an output voltage to the mode switches 110 and 112. The charge controller also provides a charging voltage for the battery 122 (if a battery is included in the system). In AC mode of operation (and in solar and dynamo modes of operation), mode switch 112 is open to isolate the battery, while mode switch 110 is configured to couple the output of the charge controller to the LED driver. The LED driver circuit receives the output voltage of the charge controller 116 and provides a constant current output for the LED array 102 to light the LEDs.

The dual power output control circuit 104 is used to provide a low power mode of operation of the lamp 100 when operated from battery power. In the AC, dynamo, and solar modes of operation, the dual power output control circuit is controlled to operate in normal, high power mode of operation.

Operation in solar mode is the same as in AC mode except that the charge controller 116 receives DC input power provided by the DC-DC converter 118. In one embodiment, the DC-DC converter is configured to receive DC power from an external solar power system having a voltage between 16 volts and 21 volts and to provide output DC power of 9.8 volts to the charge controller 116. In other embodiments, other voltages may be used to accommodate operation with other solar power systems.

Operation in dynamo mode is the same as in AC mode except that the charge controller 116 receives DC input power provided by the regulator 129. In one embodiment, the regulator is configured to receive DC power from the dynamo 127 and to provide output DC power of 9.8 volts to the charge controller 116. In other embodiments, other voltages may be used to accommodate operation with other solar power systems. In some embodiments, the lamp is configured so that the dynamo 127 is utilized to provide power to the LEDs 102 directly, and also used to provide power to charge the battery 122.

In battery mode of operation, DC power is provided from the battery 122 to the internal switch 112, and both mode switch 112 and mode switch 110 are configured to couple the output of the battery to the input of the LED driver. In one embodiment, the lighting system is configured to operate with a battery having an output voltage of 9 volts to 10.5 volts, but in other embodiments, other battery voltages may be used. In at least one embodiment, the lighting system is configured to operate with an external battery to accommodate larger, higher capacity batteries, however, in other embodiments, an internal battery may be used in addition to an external battery or in place of the external battery.

The detection circuit 108 detects the presence of AC, dynamo, and solar power, and in one embodiment, controls the charge controller 116 to select operation from the solar power source when both AC power and solar power is available to operate the lighting system 100 in a more economical manner. In some embodiments, whenever both AC and solar power is available, the charge controller 116 will preferentially utilize power derived from the solar power input to charge the battery. In some embodiments, whenever both dynamo and solar power is available, the charge controller 116 will preferentially utilize power derived from the dynamo power input to charge the battery. In some embodiments, whenever all of AC, dynamo, and solar power are available, the charge controller 116 will preferentially utilize power derived from the solar power input to charge the battery. The detection circuit 108 also provides a signal to the dual power output control circuit 104 to control the circuit for high power operation if one of AC power, dynamo power, or solar power is available. If none of AC power, dynamo power, nor solar power is available, then the detection circuit 108 controls the dual power output control circuit to operate in low power mode. Operation of the lighting system at low power in battery mode of operation allows the battery to operate for a longer period of time. In one embodiment, the dual power output control circuit 104 is implemented using parallel resistors in series with the LED array, and a switch (such as a transistor) is used to alter the value of the resistance in series with the LED array to limit the drive current to the LED array. In one embodiment, the total current through the LED array is 580 mA in high power mode of operation and is reduced to 500 mA in low power mode of operation. However, depending on the number and type of LEDs used in the array, other values of drive current may be used in other embodiments.

As shown in FIG. 9, switch 110 is a manually operated switch that may be used by a user to power the lighting system 100 on and off. As shown in FIG. 9, in one embodiment, the switch 110 is connected between charge controller 116 output, internal switch 112, and LED driver 106. A dimmer 130 is also provided in some embodiments, which provides for a user to manually control the brightness of the lamp and the power consumed. In some embodiments, the dimmer may be located in a different position than is illustrated in FIG. 9. For example, in some embodiments, the dimmer 130 is located between the switch 110 and the LED driver 106. In some embodiments, the dimmer 130 comprises a potentiometer. The dimmer 130, in some embodiments, is manually operated by a knob or switch (not shown) extending from the body of the lamp.

In one embodiment, the internal switch 112 is a controllable switch, such as a diode. The switch may be controlled by forward biasing or reverse biasing the diode. The diode is reverse biased when power is available either from SMPS 120 and/or DC-DC converter 118 and/or regulator 129, thereby disconnecting the driver 106 from the battery 122. The diode is forward biased when power is not available either from SMPS 120 and/or DC-DC converter 118 and/or regulator 129 and the lamp 100 is powered from the battery 122. In one embodiment, switch 112 is controlled to be in the open position if solar, dynamo, or AC power is available, and if none of these is available, the switch 112 is closed to couple the battery 122 to the LED driver. In one embodiment, the battery monitoring circuit 114 is coupled to output of battery 122 and LED driver 106. This circuit monitors remaining charge of the battery and gives a signal to the driver 106 to cut off the power supply to LED array 102 when the battery drains to 50% of its full charge level. In other embodiments, the battery may be drained to 80% of its full charge level. The red indication LED is illuminated when the battery drains to 50% of its full charge capacity and the switch 110 is ON position.

As discussed in more detail below, in at least some embodiments, the lamp 100 is a modular, upgradeable assembly, having several versions, and the specific electronics contained in the lamp can be varied based on the particular version of the lamp. More specifically, the SMPS board, the dynamo board (comprising the dynamo 127 and regulator 129), and the solar board may be removed or upgraded to change the version of the lamp. To easily accommodate changing the SMPS board, the dynamo board, and the solar board, connection between the boards is accomplished, in one embodiment, using flexible cables between the boards with terminal block connectors coupling the cables to the boards. The LED driver board, the solar board, the dynamo board, and the SMPS board are, in one embodiment, all mounted within the base 103 of the lamp 100.

The light emitting panels 101, in one embodiment, contain the LED array 102 mounted on a printed circuit board with the board electrically coupled to the LED driver board.

As briefly discussed above, in one embodiment, the lamp 100 can be modular and easily configured between multiple different versions. The modularity allows cost-efficient operation that effectively matches the lamp to a user based on power available to the user, allowing a user to purchase only the electronic circuitry needed to match the power sources available. In one embodiment, six different versions are provided. The four versions include: (1) LED lamp powered by battery only; (2) LED lamp powered by AC supply with a battery backup; (3) LED lamp powered by solar panel with a battery backup, (4) LED lamp powered by dynamo with a battery backup, (5) LED lamp powered by AC supply or solar panel with a battery backup; and (6) LED lamp powered by AC supply or solar panel or dynamo with a battery backup. Version 1 is considered the most basic version and with additional circuitry added, version 1 can be upgraded to any one of versions 2, 3, or 4. Each of versions 2, 3, and 4 is considered an intermediate version and each of these can be upgraded to versions 5 or 6 which are considered advanced versions. The functional block diagram shown in FIG. 9 is representative of version 6, an advanced version, in accordance with one embodiment.

Figure 10:
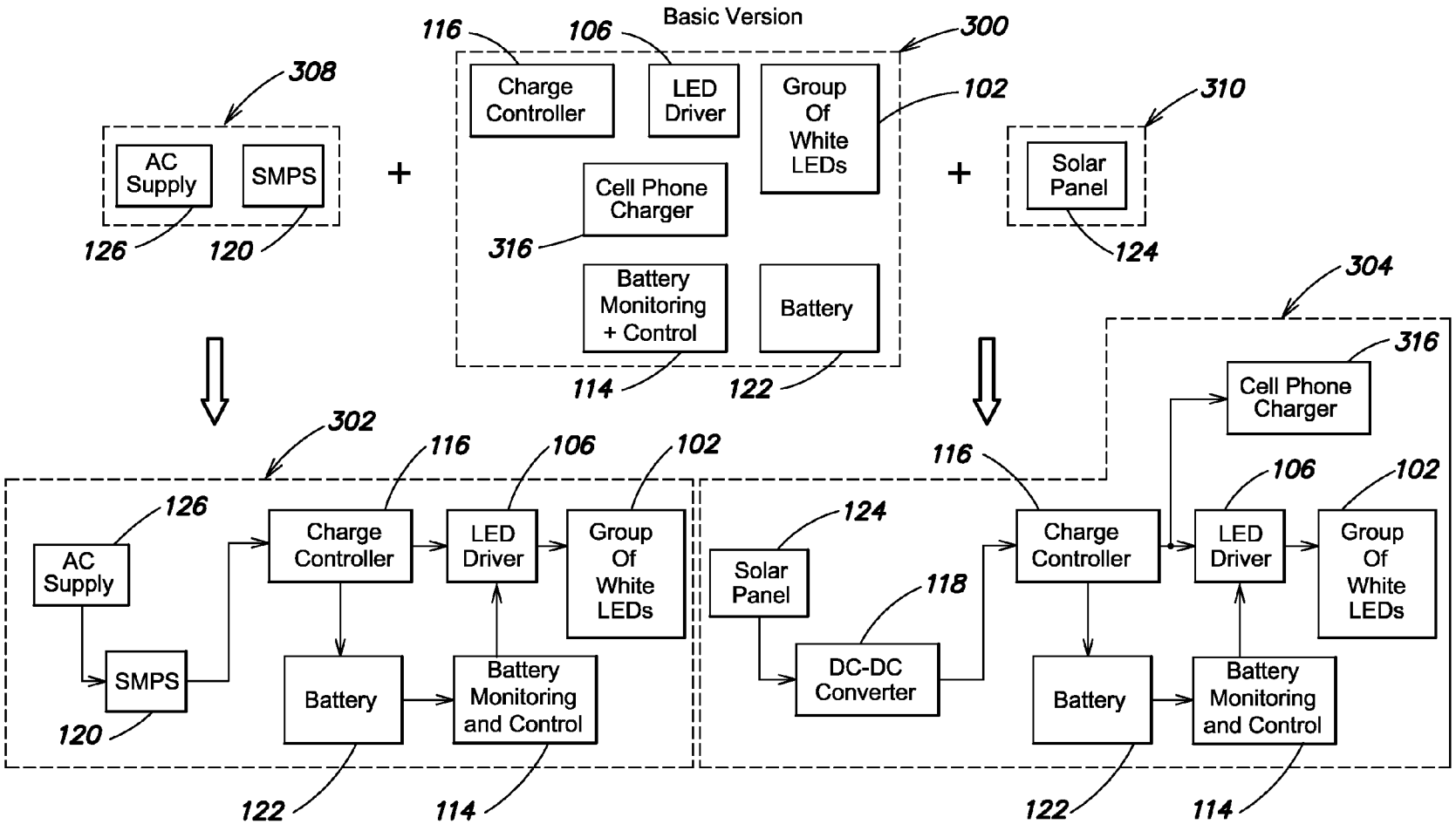
FIG. 10 shows a functional block diagram of a lamp in accordance with another embodiment.
Figure 11:
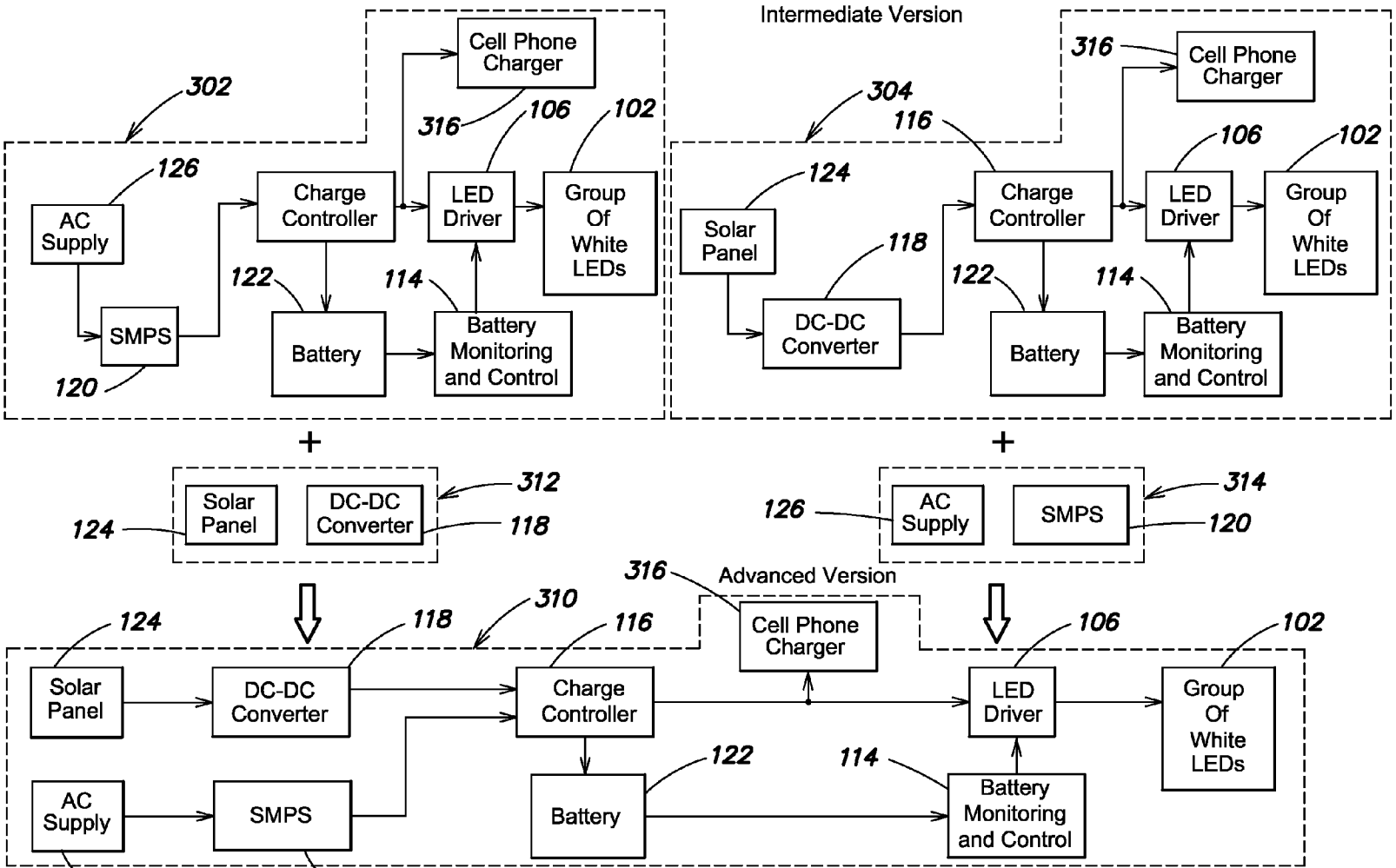
FIG. 11 shows a functional block diagram of a lamp in accordance with another embodiment.

Functional block diagrams of the different versions of the lamp 100 are shown in FIGS. 10 and 11, along with representations of the differences between the versions. FIGS. 10 and 11 illustrate versions 1, 2, 3, and 5. For clarity, the additional circuitry for versions 4 and 6 are not illustrated. Versions 4 and 6 would be similar to the versions illustrated in FIGS. 10 and 11, but with the dynamo board substituted for or added in addition to the AC board 308 and/or solar board 310 shown. Reference numerals used for the functional circuit blocks in the functional block diagrams of FIGS. 10 and 11 are the same as those used in FIG. 9. The basic version 300 includes the array of LEDs 102, the LED driver circuitry 106, the battery monitoring and control circuitry 114, the charge controller 116, and the battery 122. The battery 122 may be an internal battery or a larger external battery to provide additional capacity. In one embodiment, the basic version also includes the detection circuit 108 and the dual power circuit 104 of FIG. 9.

As illustrated in FIG. 10, the basic version can be upgraded to either the intermediate version (2) 302 or the intermediate version (3) 304 by adding additional functional module 308 or 310, respectively. Functional module 308 includes the SMPS 120, and an AC supply 126. Functional module 310 includes the DC-DC converter 118 and the solar power source 124. In some embodiments of the invention, the AC source is not included on the body of the lamp, but rather a connection for an AC source is added, and similarly, solar panels and associated devices are not added to the body of the lamp, but rather a connection to a source of solar power is added. In a similar manner, the basic version could be upgraded to an intermediate version including a dynamo by adding a dynamo and a corresponding circuit board (not shown), As illustrated in FIG. 11, either of the intermediate versions may be upgraded to the advanced version by adding the functionality provided by either functional module 312 or functional module 314. Functional module 312 includes the DC-DC converter 118 and the solar power source 124. Functional module 314 includes the SMPS 120 and the AC supply 126. A dynamo and a functional module including circuitry such as the regulator 129 could also be added to an intermediate version to produce an advanced version of the lamp including a dynamo power source.

In the modular embodiment described above, the charge controller 116 is a part of the basic version, and accordingly, is not included in the modules added to the basic version to create the intermediate versions. In this embodiment, the lamp 100 can be configured in the basic version with the driver board included in the base 103, and both the SMPS board and the solar board removed from the base. The lamp 100 is upgraded to version (2) by adding the SMPS board in the base 103. The lamp can then be upgraded from version (2) to version (4) by adding the solar board inside the base. Version (3) is achieved by adding the solar board to version (1), and version (3) can be upgraded to version (4) with the addition of the SMPS board. In another embodiment, the charge controller 116 is not included in the basic version, but is included in both intermediate versions.

The ability to upgrade the lamp 100 allows a user to purchase an affordable light assembly to meet current needs and to upgrade the lamp 100 as additional power sources become available. The modularity also simplifies manufacturing by allowing a single upgradeable assembly to be configured in four different versions, rather than providing four separate assemblies.

Embodiments of the lamp described above use LEDs as a source of light. In other embodiments, fluorescent bulbs, compact fluorescent bulbs, incandescent bulbs, and/or other light sources may be used in place of the LEDs.

In embodiments described above, four primary sources of power are discussed: AC grid, dynamo, battery, and solar. In other embodiments, lamps may be configured for operation with other power sources, including fuel cells and wind power in place of, or in addition to AC grid, dynamo, battery, and solar power.

Any references above to front and back, left and right, top and bottom, or upper and lower and the like are intended for convenience of description, not to limit the present systems and methods or their components to any one positional or spatial orientation.

Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements to single or plural configurations.

Any embodiment disclosed herein may be combined with any other embodiment, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. Such terms as used herein are not necessarily all referring to the same embodiment. Any embodiment may be combined with any other embodiment in any manner consistent with the aspects and embodiments disclosed herein.

References to "or" may be construed as inclusive so that any terms described using "or" may indicate any of a single, more than one, and all of the described terms.

Where technical features in the drawings, detailed description or any claim are followed by references signs, the reference signs have been included for the sole purpose of increasing the intelligibility of the drawings, detailed description, and claims. Accordingly, neither the reference signs nor their absence have any limiting effect on the scope of any claim elements.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A portable lamp comprising:

a base having an upper surface;

a substrate coupled to the base on the upper surface of the base, the substrate including at least one surface having a plurality of light emitting units disposed thereon, the substrate being movable relative to the base to direct light emitted from the light emitting units in a desired direction;

a light-transmitting cover surrounding the substrate; and a modular power supply configurable between multiple versions, the modular power supply including circuitry configured to supply the lamp with power from a first source of power and including electrical connections configured to receive one or more functional modules configured to supply the lamp with power from one or more additional sources of power.

2. The portable lamp of claim 1, wherein the substrate includes at least two panels rotatably mounted about a vertical axis perpendicular to the upper surface of the base, a first of the at least two panels being rotatable relative to a second of the at least two panels.

3. The portable lamp of claim 2, wherein each of the plurality of light emitting units comprises a light emitting diode.

4. The portable lamp of claim 2, wherein the at least two panels are configured to rotate into positions such that the at least two panels are substantially coplanar.

5. The portable lamp of claim 2, wherein the at least two panels are configured to rotate into positions wherein the at least two panels substantially circumscribe a closed two dimensional polygon oriented perpendicular to the vertical axis.

6. The portable lamp of claim 2, wherein each of the at least two panels is hingedly coupled to at least one other of the at least two panels.

7. The portable lamp of claim 2, wherein the base includes a compartment for at least one battery, and the at least two panels are configured to be powered by the at least one battery.

8. The portable lamp of claim 7, wherein the base includes a dynamo configured to be manually operated to charge the at least one battery.

9. The portable lamp of claim 7, further comprising a solar 5 cell configured to simultaneously provide power for illumination of the plurality of light emitting units as well as charge the at least one battery upon exposure of the solar cell to light.

10. The portable lamp of claim 1, further comprising an AC power inlet.

11. The portable lamp of claim 10, further comprising a first circuit configured to simultaneously provide power for illumination of the plurality of light emitting units as well as charge a battery included in the portable lamp with power provided through the AC power inlet.

12. The portable lamp of claim 11, further comprising a second circuit configured to detect the availability of power from the AC inlet and the solar cell, and when power is available from both the AC inlet and the solar cell, to operate the lamp using power from the solar cell only.

13. The portable lamp of claim 11, further comprising a third circuit configured to detect the unavailability of power from the AC inlet, the solar cell, and the dynamo, and in response, switch from a mode in which the substrate is operated utilizing power provided through the AC inlet, the solar cell, or the dynamo to a mode in which the substrate is operated utilizing power provided by the battery.

14. A method of operating a lamp including a plurality of configurable lighting panels, the method comprising:

supplying power to the lamp from a modular power supply configurable between multiple versions, the modular power supply including circuitry configured to supply the lamp with power from a first source of power and including electrical connections configured to receive one or more functional modules configured to supply the lamp with power from one or more additional sources of power;

electrically coupling one of the first source of power and one of the one or more additional sources of power to the plurality of configurable lighting panels; and orienting the plurality of configurable lighting panels in a desired position ranging from an open position in which the plurality of configurable lighting panels are positioned in a substantially planar configuration and a closed position in which the plurality of configurable lighting panels circumscribe a substantially closed two dimensional figure.

15. The method of claim 14, further comprising electrically coupling a source of power positioned external to the lamp to a source of power positioned internal to the lamp.

16. The method of claim 14, further comprising orienting the plurality of configurable lighting panels into an intermediate position in which the plurality of configurable lighting panels are positioned in a substantially non-planar configuration.

17. A lamp comprising:

a base;

a modular power supply configurable between multiple versions, the modular power supply including circuitry configured to supply the lamp with power from a first source of power and including electrical connections configured to receive one or more functional modules configured to supply the lamp with power from one or more additional sources of power; and a plurality of light panels, each configured to extend from the base in a first direction defined by a first axis, and each having a plurality of lighting elements configured to provide illumination along at least one of a plurality of axes that reside in a first plane which is perpendicular to the first axis;

wherein each of the plurality of light panels are rotatably mounted to the base and rotatable about a rotation axis that is parallel to the first axis.

18. The lamp of claim 17, wherein a first of the plurality of light panels is rotatable relative to a second of the plurality of light panels.

19. The lamp of claim 18, wherein the first of the plurality of light panels and the second of the plurality of light panels are configured to rotate into positions such that the first of the plurality of light panels and the second of the plurality of light panels are substantially coplanar.

20. The lamp of claim 18, wherein the first of the plurality of light panels and the second of the plurality of light panels are configured to rotate to a position wherein the first of the plurality of light panels and the second of the plurality of light panels substantially circumscribe a closed two dimensional figure oriented perpendicular to the first axis.

21. The lamp of claim 17, wherein each of the plurality of light panels is hingedly coupled to at least one other of the plurality of light panels.

* * * * *